United States Patent [19]

Renaud et al.

[11] Patent Number: 4,480,792

[45] Date of Patent: Nov. 6, 1984

[54] FUEL INJECTOR WITH GEAR-DRIVEN CALIBRATION OF NEEDLE

[75] Inventors: Patrick Renaud, Versailles; Jean-Paul Bourget, Lesigny, both of France

[73] Assignee: Societe d'Etudes de Machines Thermiques S.E.M.T., Saint Denis, France

[21] Appl. No.: 390,928

[22] Filed: Jun. 22, 1982

[30] Foreign Application Priority Data

Aug. 7, 1981 [FR] France ..... 81 15406

[51] Int. Cl.[3] ..... F02M 61/10

[52] U.S. Cl. ..... 239/533.6

[58] Field of Search ..... 239/533.2–533.12, 239/584

[56] References Cited

U.S. PATENT DOCUMENTS 3,777,984 12/1973 Greathouse ..... 239/533.6

FOREIGN PATENT DOCUMENTS 2136705 12/1972 France .

736446 9/1955 United Kingdom .

1210381 10/1970 United Kingdom .

*Primary Examiner*—Andres Kashnikow

*Attorney, Agent, or Firm*—Kenyon & Kenyon

[57] ABSTRACT

A fuel injector for an internal combustion engine comprising a body traversed by an injection conduit and provided with a lateral fuel inlet located in the lower half of the body, the body containing an injector needle continued by a push-member provided with a head upon which bears a return spring urging the injection needle to the closed position and prestressed by means of an adjusting screw, the push-member being sufficiently short to allow the lateral fuel intake to be located above the upper end of the assembly constituted by the adjusting screw, the spring, the push-member and the needle.

1 Claim, 1 Drawing Figure

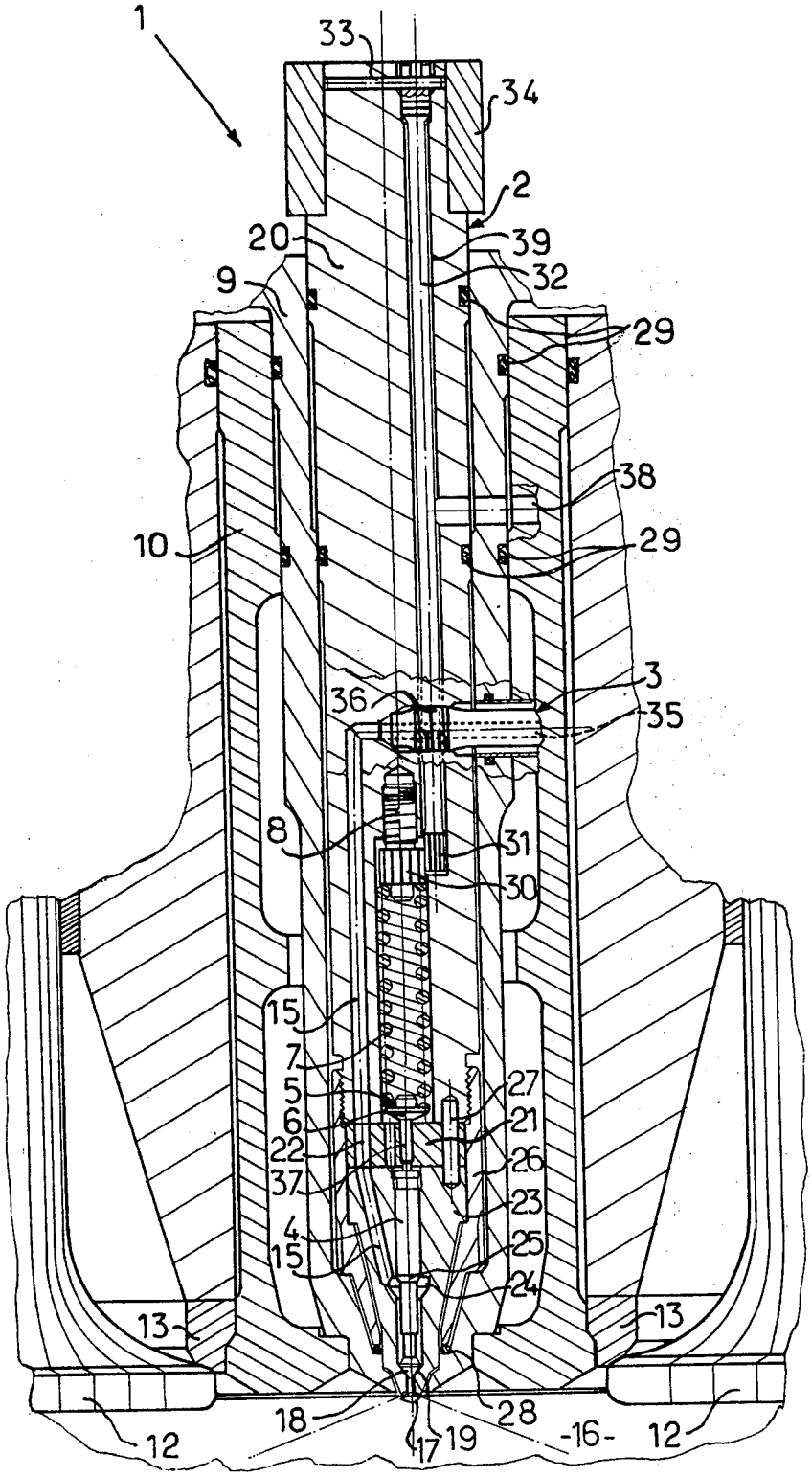
1
33
34
2
20
39
9
32
29
38
10
29
3
36
35
8
31
30
15
7
5
27
6
21
22
26
37
23
4
25
15
24
13
13
18
28
12
17
19
-16-
12

FUEL INJECTOR WITH GEAR-DRIVEN CALIBRATION OF NEEDLE

The present invention relates to a fuel injector, particularly for an internal combustion engine.

There are already known fuel injectors comprising a substantially cylindrical body traversed by a fuel injection conduit substantially parallel with the longitudinal centre line of the body and provided with a lateral fuel inlet located in the upper half of the body, said body containing, succeeding one another in the upward direction, an injection needle continued by an elongate push-member provided with a head upon which bears a return spring which urges it to the closed position and is pre-stressed by means of an adjusting screw.

However, owing to the relatively large transverse dimension of the push-member head forming a bearing abutment or seat for the return spring, as well as of the spring and its adjusting screw, compared to the transversely available room in the injector body, i.e. between the longitudinal centre line of the latter and the fuel intake conduit, it is necessary to place the push-member head with the spring and its adjusting screw above the level of fuel intake, i.e. in a region where there is available a sufficient space in radial width.

In an injector of this type, use must therefore be made of a push-member which is relatively long and the diameter of which is rather important for it must be sufficient to withstand buckling. The push-member, which is movable, therefore is relatively heavy and has a relatively considerable inert mass, resulting in troubles and disturbances in the injection, especially because of the phenomenon of injection needle bouncing on its seat. This, in addition, involves a non-inconsiderable risk of deterioration of the seat.

The purpose of the present invention is to remedy the above drawbacks by substantially shortening the push-member, which, as a result of the concomitant increase of its resistance to buckling, also allows reducing its diameter, thus permitting a quite considerable reduction in weight of this movable member.

To this end, the present invention has for a subject matter a fuel injector, particularly for an internal combustion engine, of the type comprising a substantially cylindrical body traversed by a fuel injection conduit substantially parallel to the longitudinal centre line of the said body, and provided with a lateral fuel inlet located in the lower half of the said body, the said body containing, succeeding one another upwardly, an injection needle continued by an elongated push-member provided with a head upon which bears a return spring urging it to the closed position and prestressed by means of an adjusting screw, characterized in that the said push-member is sufficiently short, in the longitudinal direction, to allow the lateral fuel intake level to be located above the upper end of the assembly constituted by the adjusting screw, the spring, the push-member and the injection needle arranged in series.

According to another characterizing feature of the invention, the aforesaid push-member is substantially shorter than the aforesaid injection needle, the length of the push-member representing for example about a quarter of that of the needle. Likewise, the length and the diameter of the said push-member may be reduced to about one tenth of and about half the length and of the diameter, respectively, of a usual push-member.

According to still another characterizing feature of the invention, the said adjusting screw is co-axially integral or jointly movable with a driven pinion meshing with a driving pinion co-axially integral or jointly movable with an actuating rod rotatably mounted in the injector body and extending up to the upper end of the injector so that it can be actuated from the outside.

The invention will be better understood and other purposes, characterizing features, details and advantages of the latter will appear more clearly as the following explanatory description proceeds with reference to the appended diagrammatic drawing given solely by way of non-limitative example, wherein the single FIGURE is an axial sectional view of the injector according to one specific and presently preferred form of embodiment of the invention, partially broken way to show the fuel supply device.

The fuel supply device (1), particularly for an internal combustion engine, comprises a substantially cylindrical body (2) traversed by a fuel injection conduit (15) substantially parallel with the longitudinal centre line of the body (2), and provided with a lateral fuel inlet (3) located in the lower portion of the body (2), substantially half way up the latter in the example illustrated in the appended FIGURE. The body (2) contains, succeeding one another upwardly, an injection needle (4) continued by an elongate push-member (5) provided with a head (6) upon which bears a return spring (7) urging it to the closed position and prestressed by means of an adjusting screw (8).

The body (2) of the injector (1) is arranged in a sleeve (9) located in the cylinder head (10). The reference numerals (12) denote the valves arranged on either side of the injector on their respective seats (13). Various seals (29) are moreover provided between the cylinder head (10), the sleeve (9) and the injector body (2).

The injection needle (4), the taper end (18) of which rests, in the closed position of the injector, on a taper seat, controls, in a conventional manner, the injection of fuel into the combustion chamber (16) through the medium of an injection nozzle (17).

According to the invention, the push-member is sufficiently short, in the longitudinal direction, to allow the lateral fuel intake level to be located above the upper end of the assembly constituted by the adjusting screw (8), the spring (7), the push-member (5) and the injection needle (4) placed in series.

The push-member (5) is substantially shorter than the injection needle (4), the length of the push-member representing for example about a quarter of that of the needle. It may also be noted that the length and the diameter of the push-member (5) are reduced to about one tenth of and about half, respectively, the length and the diameter of a usual push-member.

In the form of embodiment illustrated, the injector body (2) comprises an upper portion (20) where the injection conduit (15) is substantially parallel with the longitudinal centre line of the body (2). The lateral fuel intake level is located substantially half way up the body of the injector above the adjusting screw (8) and the fuel supply device comprises an intake conduit (35) connected by an assembling screw (36) to the conduit (15). The injector body (2) also comprises an interposed member (21) surrounding the body (37) of the push-member (5) and a lower portion (23) where the injection conduit (15) is oblique and opens into an annular groove (24). The interposed member (21) is provided with a bore (22) which interconnects the two portions of the injection conduit located in the upper and lower portions (20) and (23), respectively, of the injector body (2). The mounting of the interposed member (21) is facilitated by a centering stud (27). The upper and lower portions (20) and (23), respectively, as well as the interposed member (21) are assembled together by a member (26) surrounding the lower portion (25), the interposed member (21) and the lower end of the upper portion (20), the fluid tightness at the base of the member (26) being ensured by a metal O-ring (28).

Furthermore, the adjusting screw (8) is co-axially integral or jointly movable with a driven pinion (30) meshing with a driving pinion (31) co-axially integral or jointly movable with an actuating stem (32) mounted rotatably in the body (2) of the injector (1) and extending up to the upper end of the injector so that it can be actuated from the outside. A pin (33) for locking the upper end of the actuating stem (32) is provided. There is also provided at the upper end of the body (2) of the injector (1) of a clamping collar (34) for securing the injector in the cylinder head. Also provided is a fuel leakage return passage (38) passing particularly through the cylinder head (10), the sleeve (9) and the injector body (2) and opening into the cavity containing the actuating stem (32) in the injector body (2).

The operation of an injector of the above type is well known and will be briefly described hereafter. On each injection pump actuating cycle a certain amount of fuel is delivered under pressure from the injection conduit (15) and enters the annular chamber (24). The fuel pressure first produces a pushing force which acts upon the shoulder (25) of the needle (4) to raise the taper end (18) of the said needle from its seat (19). A fuel portion is then expelled by the injection nozzle (17) into the combustion chamber (16). The injection continues until the fuel pressure acting upon the shoulder (25) is insufficient to overcome the force of the return spring (7). Thereafter, the needle is reapplied onto its seat (19) and the injection is discontinued until the following cycle.

Nevertheless, due to the fact that, according to the invention, the push-member (5) is of reduced length and therefore has a relatively small inert mass it allows the fuel injection to be improved, permitting particularly the disturbances resulting from the bouncing of the injection needle on its seat, which occurs with a relatively heavy push-member of a usual type, to be avoided.

Moreover, the force of the return spring (7) may be easily adjusted by actuating from the outside the driving stem (32) which actuates the adjusting screw (8).

What is claimed is:

1. A fuel injector for an internal combustion engine, the fuel injector comprising a substantially cylindrical body having a fuel injection conduit extending substantially parallel to the longitudinal axis of the body and provided with a lateral fuel inlet, said body containing, in longitudinal succession, an injection needle continued by an elongate push-member provided with a head upon which bears a return spring urging the injection needle to the closed position and pre-stressed by means of an adjusting screw, wherein the improvement comprises the adjusting screw is coaxially integral with a driven pinion meshing with a driving pinion coaxially integral with a driving stem mounted rotatably in the body of the injector and extending up to the upper end of the injector so that it can be operated from the outside of the cylindrical body.

* * * * *